US006234474B1

(12) United States Patent
Horii et al.

(10) Patent No.: US 6,234,474 B1
(45) Date of Patent: May 22, 2001

(54) PAPER ACCUMULATING DEVICE

(75) Inventors: Yoshiyuki Horii, Kyoto; Masayuki Kashiba, Shinasahimachi; Masato Nogawa, Ikagun, all of (JP)

(73) Assignee: Horizon International Inc., Shiga (JP)

( * ) Notice: Subject to any disclaimer, the term of this patent is extended or adjusted under 35 U.S.C. 154(b) by 0 days.

(21) Appl. No.: 09/336,695

(22) Filed: Jun. 21, 1999

(30) Foreign Application Priority Data

Jun. 23, 1998 (JP) ..... 10-214738

(51) Int. Cl.[7] ..... B65H 39/10; B65H 33/04
(52) U.S. Cl. ..... 271/288; 271/294; 270/58.09
(58) Field of Search ..... 270/58.07, 58.09, 270/58.14, 58.23; 271/279, 299, 297, 303, 288

(56) References Cited

U.S. PATENT DOCUMENTS

| | | | | |
|---|---|---|---|---|
| 2,697,388 | | 12/1954 | Hansen et al. . | |
| 4,102,253 | * | 7/1978 | Gannicott | 93/93 X |
| 4,373,713 | * | 2/1983 | Loebach | 271/303 |
| 4,477,218 | | 10/1984 | Bean . | |
| 4,534,552 | * | 8/1985 | Rahe | 271/279 |
| 4,926,220 | | 5/1990 | Matysek et al. | 355/313 |
| 4,948,112 | * | 8/1990 | Sato et al. | 270/60 X |
| 5,188,353 | | 2/1993 | Parks . | |
| 5,293,797 | * | 3/1994 | Spalding et al. | 83/70 X |
| 5,666,630 | | 9/1997 | Zoltner et al. | 399/405 |
| 5,732,609 | * | 3/1998 | Marschke | 83/92.1 X |
| 6,000,695 | * | 12/1999 | Mack et al. | 271/303 |

FOREIGN PATENT DOCUMENTS 1167728 10/1969 (GB) .

* cited by examiner

*Primary Examiner*—Joseph E. Valenza
*Assistant Examiner*—Kenneth W Bower
(74) *Attorney, Agent, or Firm*—Armstrong, Westerman, Hattori, McLeland & Naughton, LLP

(57) ABSTRACT

A paper accumulating device (20) according to the present invention comprises a paper bundle feeding port (31), a plurality of paper bundle receiving portions (33, 34) including paper bundle receivers (21, 22) for accumulating paper bundles respectively, a delivery path (23, 24, 25) for delivering the paper bundles sequentially fed to the paper bundle feeding port to the paper bundle receiving portions (33, 34). The paper bundle receiving portions (33, 34) are provided with sorting mechanisms (40, 60) for sorting the delivered paper bundles. The delivery path includes a main delivery path portion (23) extended from the paper bundle feeding port (31) to a branch point (32), and a plurality of branch delivery path portions (24, 25) extended from the branch point (32) to the related paper bundle receiving portions (33, 34) respectively. The branch point (32) is provided with a switching gate plate (26) for operating to selectively connect the main delivery path portion (23) to the branch delivery path portions (24, 25) respectively.

4 Claims, 4 Drawing Sheets

PAPER ACCUMULATING DEVICE

BACKGROUND OF THE INVENTION

The present invention relates to a paper accumulating device for sorting and accumulating a bundle of papers which are sequentially fed.

The paper accumulating device generally comprises a paper bundle feeding port, a paper bundle receiving portion for accumulating a bundle of papers, a delivery path extended between the paper bundle feeding port and the paper bundle receiving portion, and delivery means for delivering the paper bundle to be sequentially fed to the paper bundle feeding port along the delivery path to the paper bundle receiving portion. Furthermore, the paper bundle receiving portion is provided with a sorting mechanism for sorting the delivered paper bundle.

Thus, the adjusted paper bundle is sequentially fed from a sheet collator to the paper bundle feeding port of the paper accumulating device. The fed paper bundle is delivered along the delivery path and is sorted and accumulated onto the paper bundle receiving portion. When the paper bundle is accumulated onto the paper bundle receiving portion up to a predetermined height, it is sent from the paper accumulating device to a processing device at the next step, such as a filing device, or the like.

For example, the sorting mechanism serves to sort the paper bundle by alternately shifting the paper bundle sequentially delivered to the paper bundle receiving portion right and left with respect to a delivery direction. FIG. 4 shows a state in which the paper bundle is thus sorted and accumulated in the paper bundle receiving portion. In FIG. 4, the ends of the papers are adjusted for each paper bundle and the paper bundles are alternately shifted and accumulated. More specifically, the paper bundle is divided into a set in which one of the ends of the bundles make a string of A1 to AX and a set in which the other ends make a string of B1 to BX. Thus, the paper bundles are alternately shifted and accumulated so that work for separately sorting the paper bundles is not required at the next step, such as the filing process, or the like. Accordingly, it is possible to obtain an advantage that a bookbinding process can efficiently be performed.

The above-mentioned sorting mechanism includes means for reciprocating right and left with respect to the delivery direction of the paper bundles to alternately distribute the paper bundles fed to the paper bundle receiving portion right and left with respect to the delivery direction. The reciprocating means, is driven by driving means such as a motor. The reciprocation requires a constant time.

On the other hand, the operating speed of the sheet collator, that is, a paper discharging speed tends to be increased by the progress of technology. However, the operating speed of the sorting mechanism of the paper bundle receiving portion is lower than the paper discharging speed of the sheet collator, and the increase in the operating speed of the sorting mechanism also has a limitation. In order to deliver the paper bundles to the paper bundle receiving portion according to the operation of the sorting mechanism, therefore, the paper discharging speed of the sheet collator should be adapted to the operating speed of the sorting mechanism. For this reason, the paper discharging speed of the sheet collator is set to a lower speed than the possible maximum speed. Consequently, there has been a problem in that the capability of the sheet collator cannot fully be exhibited.

SUMMARY OF THE INVENTION

Therefore, it is an object of the present invention to provide a paper accumulating device capable of sorting and accumulating paper bundles at a high speed according to a maximum operating speed (paper discharging speed) that a sheet collator can exhibit.

In order to attain the above-mentioned object, the present invention provides a paper accumulating device comprising a paper bundle feeding port, a plurality of paper bundle receiving portions including paper bundle receivers for accumulating paper bundles, and a delivery path for delivering the paper bundles sequentially fed to the paper bundle feeding port to the paper bundle receiving portions, the paper bundle receiving portions being provided with sorting mechanisms for sorting the delivered paper bundles, wherein the paper bundle receiving portions are provided, the delivery path includes a main delivery path portion extended from the paper bundle feeding port to a branch point, and a plurality of branch delivery path portions extended from the branch point to the related paper bundle receiving portions respectively, and the branch point is provided with a switching gate plate for operating to selectively connect the main delivery path portion to the branch delivery path portions respectively.

According to a preferred embodiment of the present invention, the paper accumulating device further comprises a control portion for controlling the operation of the switching gate plate and that of the sorting mechanisms of the paper bundle receiving portions according to a delivery speed of the paper bundle.

According to another preferred embodiment of the present invention, the paper bundle receiving portions are arranged in a line toward the paper bundle feeding port and the branch delivery path portion related to one of the paper bundle receiving portions is provided across an upper portion of the paper bundle receiving portion closer to the paper bundle feeding port than the paper bundle receiving portion.

According to a further preferred embodiment of the present invention, the paper bundle feeding port sequentially receives the feeding of the paper bundles adjusted by the sheet collator and includes the two paper bundle receiving portions, the paper bundle receiver provided on each paper bundle receiving portion includes a sensor for detecting that accumulation of the paper bundles is completed in the paper bundle receiver, the paper accumulating device further comprising a control portion for controlling operation of the switching gate plate and a paper discharging speed of the sheet collator, the control portion actuating the switching gate plate in such a manner that the paper bundles are alternately delivered to the two paper bundle receiving portions until the accumulation of the paper bundles is completed in one of the paper bundle receivers, actuating the switching gate plate in such a manner that the paper bundles are delivered to only one of the paper bundle receiving portions before the other paper bundle receiver is exchanged for a new empty paper bundle receiver when the sensor detects that the accumulation of the paper bundles has been completed in the paper bundle receiver, and lowering the paper discharging speed of the sheet collator to be adapted to an operating speed of the sorting mechanism of the other paper bundle receiving portion.

DETAILED DESCRIPTION OF PREFERRED EMBODIMENT

Figure 1:
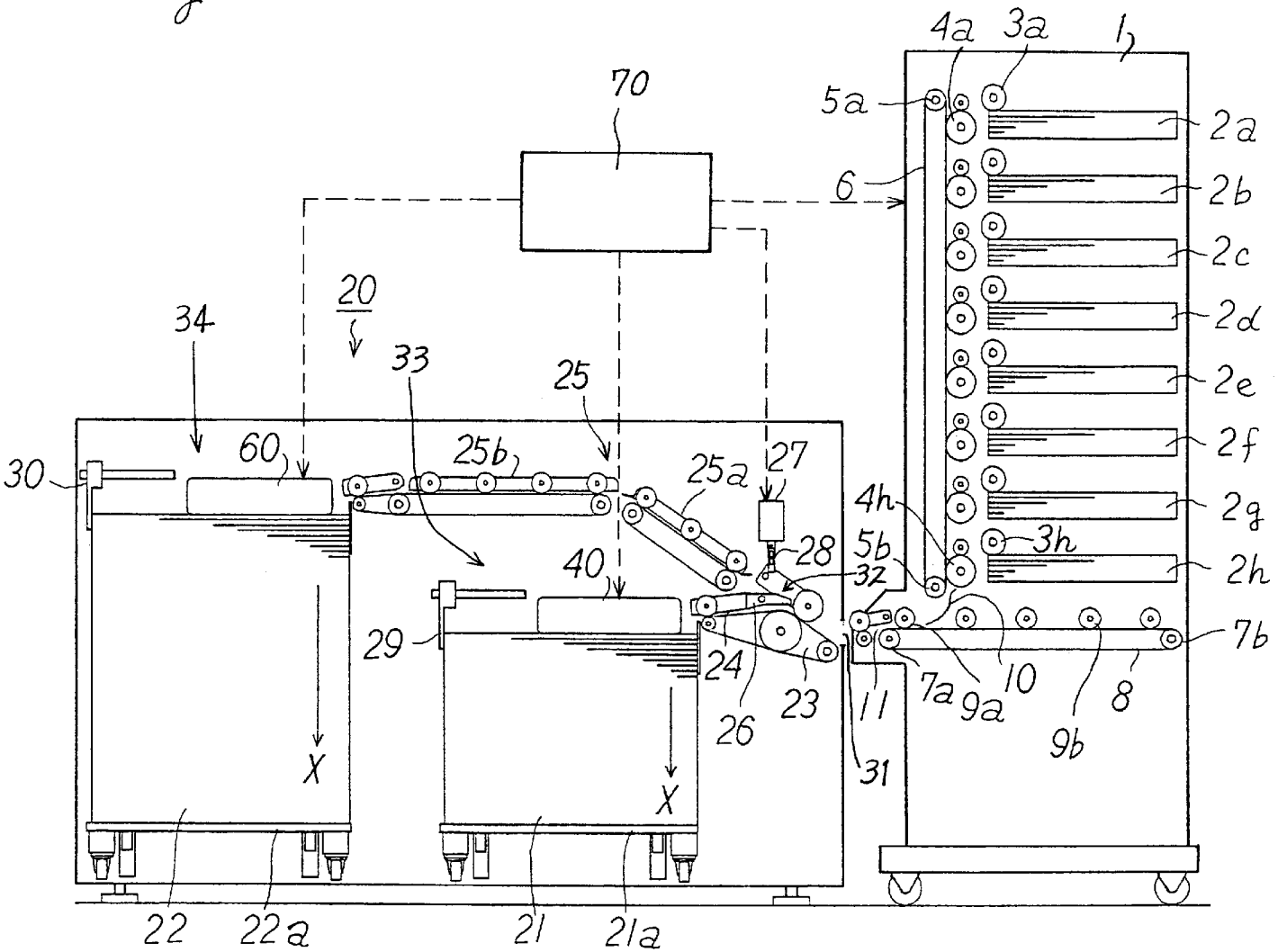
FIG. 1 is a schematic side view showing a paper accumulating device according to a first embodiment of the present invention.

FIG. 1 is schematic side view showing a paper accumulating device according to an embodiment of the present invention. As shown in FIG. 1, a paper accumulating device 20 according to the present invention is connected to a sheet collator 1. The adjusted paper bundles are sequentially fed from the sheet collator 1.

The sheet collator 1 includes eight paper supply shelves 2*a* to 2*h* spaced in a longitudinal direction. A predetermined number of papers representing the same page are housed in each of the paper supply shelves 2*a* to 2*h*. Paper feeding rollers 3*a* to 3*h* are provided on the paper feeding side of each of the paper supply shelves 2*a* to 2*h*. The paper discharged from each of the paper supply shelves 2*a* to 2*h* by means of the paper feeding rollers 3*a* to 3*h* is fed to a longitudinal delivery belt 6 through vertical feeding rollers 4*a* to 4*h*.

The longitudinal delivery belt 6 is driven by driving rollers 5*a* and 5*b* for the vertical delivery belt which are spaced in a vertical direction. The papers fed from each of the paper supply shelves 2*a* to 2*h* to the longitudinal delivery belt 6 are sequentially stacked and adjusted in order of pages while they are being delivered downward in the vertical direction by means of the belt 6. Thus, a paper bundle for one book is formed.

A horizontal and transverse delivery belt 8 is provided in a position spaced from the lower end of the longitudinal delivery belt 6. The transverse delivery belt 8 is driven by the driving rollers 7*a* and 7*b* for the transverse delivery belt which are spaced in a horizontal direction.

The adjusted paper bundles are transferred from the lower end of the longitudinal delivery belt 6 to the transverse delivery belt 8 through a guide plate 10. A paper discharging roller 9*a* is provided on an end of the transverse delivery belt 8 on the side of the paper discharging port 11. The paper bundles are sent to the paper discharging port 11 through the paper discharging roller 9*a*. The reference numeral 9*b* denotes a feeding roller for feeding the paper bundles supplied from another sheet collator to the transverse delivery belt 8 if a plurality of sheet collators are to be coupled for use.

The paper accumulating device 20 according to the present invention comprises a paper bundle feeding port 31, first and second paper bundle receiving portions 33 and 34 including first and second paper bundle receivers 21 and 22 for accumulating paper bundles, and delivery paths 23, 24 and 25 for delivering the paper bundles sequentially fed to the paper bundle feeding port 31 to the first and second paper bundle receiving portions 21 and 22.

The delivery paths 23, 24 and 25 include a main delivery path portion 23 extended from the paper bundle feeding port 31 to a branch point 32, and first and second branch delivery path portions 24 and 25 extended from the branch point 32 to the first and second paper bundle receiving portions 33 and 34, respectively. The second branch delivery path portion 25 is formed by two portions, that is, an upstream side portion 25*a* and a downstream side portion 25*b*.

The first and second paper bundle receiving portions 33 and 34 are provided in a line toward the paper bundle feeding port 31. The second branch delivery path portion 25 related to the second paper bundle receiving portion 34 is provided across the upper portion of the first paper bundle receiving portion 33.

Each of the first and second paper bundle receivers 21 and 22 is formed by a pallet forming the receivers having a caster. The pallets 21 and 22 can be easily exchanged for another pallet by movement in a direction perpendicular to the delivery paths 23, 24 and 25.

Although the volume of the pallet forming the second receiver 22 is greater than that of the first pallet in FIG. 1, the volumes of the first and second pallets may be equal to each other and the volume of the pallet of first receiver 21 may be greater than that of the second receiver 22.

On the branch point 32 is provided a switching gate plate 26 for operating to selectively connect the main delivery path portion 23 to the first branch delivery path portion 24 or the second branch delivery path portion 25. The switching gate plate 26 is connected to a rod 28 for reciprocating by the operation of an electromagnetic solenoid 27 by means of a suitable coupling mechanism (not shown). By the operation of the electromagnetic solenoid 27, the rod 28 reciprocates so that the switching gate plate 26 reciprocates and rotates. Consequently, the main delivery path portion 23 is selectively connected to the first branch delivery path portion 24 or the second branch delivery path portion 25. In FIG. 1, the main delivery path portion 23 is connected to the first branch delivery path portion 24. Instead of the electromagnetic solenoid 27, other electric actuators may be arranged for moving the switching gate plate 26. An oil hydraulic actuator or a pneumatic actuator may be used instead of the electric actuator.

First and second sorting mechanisms 40 and 60 are provided on the upper ends of the first and second paper bundle receiving portions 33 and 34 in the vicinity of the outlets of the related branch delivery path portions 24 and 25, respectively. These sorting mechanisms 40 and 60 are fixed to frames of the related paper bundle receiving portions 33 and 34, respectively. The sorting mechanisms 40 and 60 serve to alternately shift the paper bundles sequentially fed to the related paper bundle receiving portions 33 and 34 right and left with respect to the delivery direction, thereby sorting the same paper bundles. The structures of the sorting mechanisms 40 and 60 will be described below in detail.

A stopper 29 is provided on the upper end of the first paper bundle receiving portion 33 on the opposite side to the outlet of the first branch delivery path portion 24. The paper bundles fed to the first paper bundle receiving portion 21 are stopped in the position of the stopper 29. The stopper 29 is fixed to the frame of the first paper bundle receiving portion 33.

The first pallet includes a paper bundle mounting plate 21*a*. The paper bundle mounting plate 21*a* is first positioned just below the first sorting mechanism 40 in the first paper bundle receiving portion 33. As the paper bundles are accumulated onto the paper bundle mounting plate 21*a*, the paper bundle mounting plate 21*a* goes downward in a direction shown by an arrow X in FIG. 1, and reaches the lowermost position of the first pallet when the first pallet is filled with the paper bundles as shown in FIG. 1. At this time, a pressure sensor (not shown) fixed to the lowermost portion of the first pallet is pushed against the paper bundle mounting plate 21*a*, thereby sensing that the first pallet is filled with the accumulated paper bundles.

Similarly, a stopper 30 is provided on the second paper bundle receiving portion 34. Furthermore, the second pallet includes a paper mounting plate 22*a* and a sensor.

Next, the structures of the first and second sorting mechanisms 40 and 60 will be described with reference to FIGS. 2 and 3. Since the first and second sorting mechanisms have the same structures, the first sorting mechanism 40 will be described below.

Figure 2:
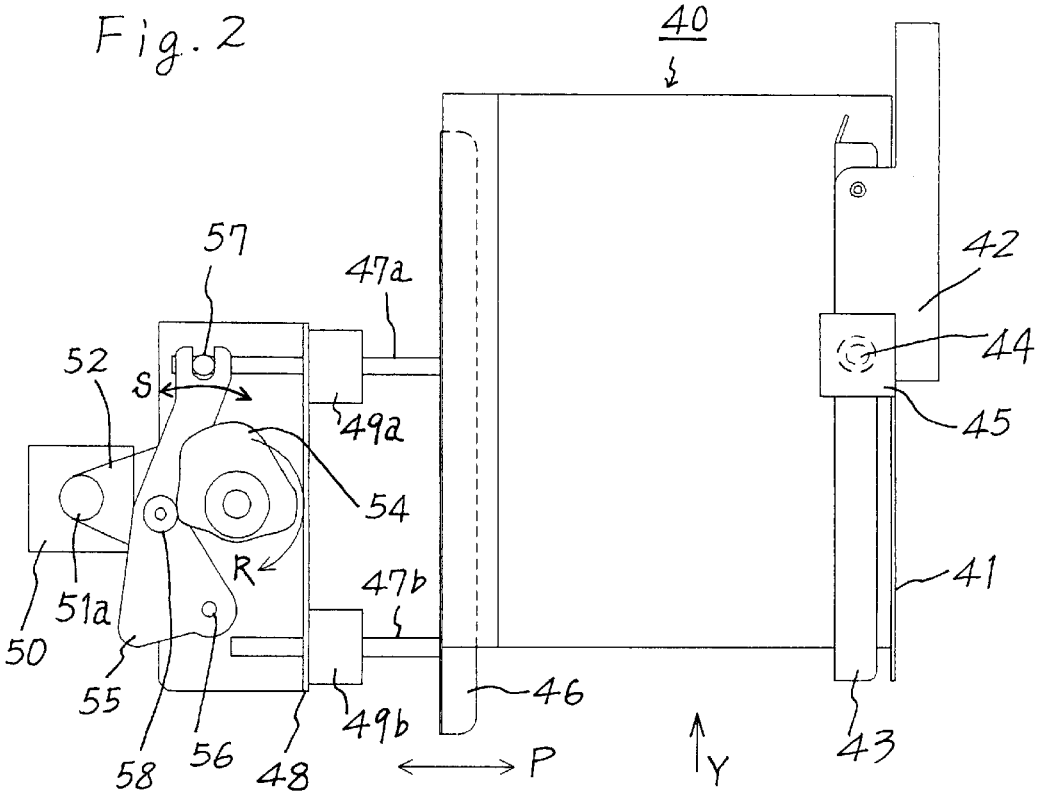
FIG. 2 is a plan view showing a sorting mechanism of the paper accumulating device illustrated in FIG. 1.
Figure 3:
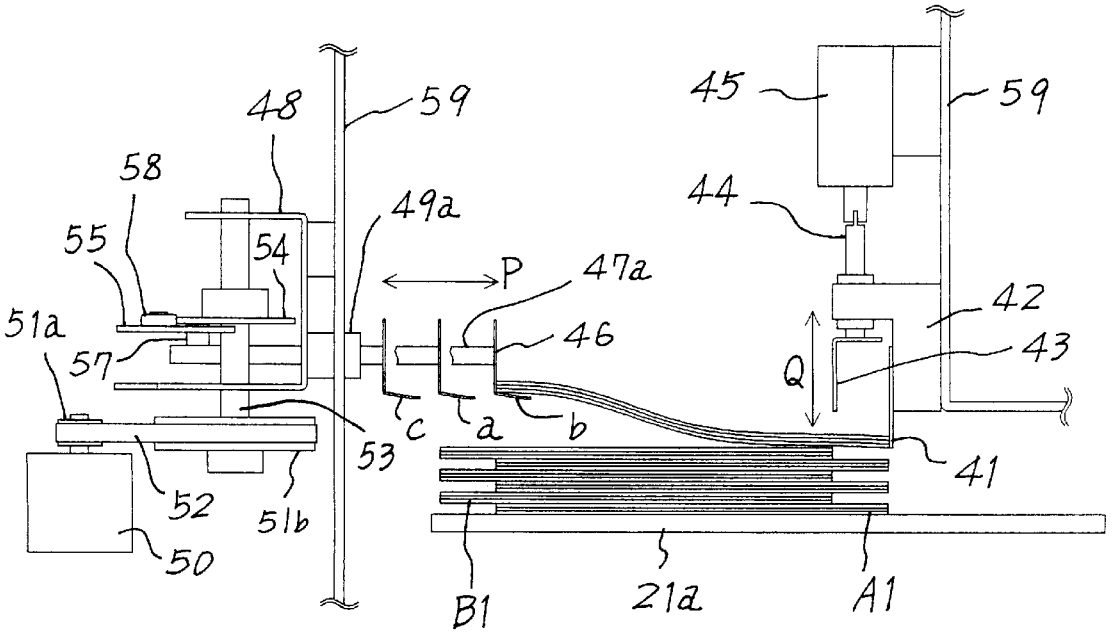
FIG. 3 is a side view showing the sorting mechanism illustrated in FIG. 2.

FIG. 2 is a plan view showing the first sorting mechanism 40, and FIG. 3 is a side view seen in a direction of an arrow Y of FIG. 2. In FIGS. 2 and 3, an inhibiting plate 41 is mounted on a fixing member 42 attached to the frame 59 of the first paper bundle receiving portion 33. An electromagnetic solenoid 45 is also attached to the frame 59. A lifting plate 43 is coupled to the electromagnetic solenoid 45 through a rod 44. The lifting plate 43 performs a lifting motion in a direction of an arrow Q by the operation of the electromagnetic solenoid 45.

The reference numeral 48 denotes a supporting member fixed to the frame 59 of the first paper bundle receiving portion 33. First and second rods 47*a* and 47*b* are supported on the supporting member 48 through bearings 49*a* and 49*b*, respectively. The first and second rods 47*a* and 47*b* can reciprocate horizontally right and left with respect to the delivery direction of the paper bundles for the first paper bundle receiving portion 33. A movable plate 46 is coupled to the tips of the first and second rods 47*a* and 47*b*. A driving motor 50 is fixed to the frame of the first paper bundle receiving portion 33 and a first pulley 51*a* is fixed to the rotary shaft of the driving motor 50. A vertical rotary shaft 53 is attached to the supporting member 48, and a second pulley 51*b* is fixed to the lower end of the rotary shaft 53. A driving belt 52 is entrained between the first and second pulleys 51*a* and 51*b*.

A lever 55 is swingably fixed onto the supporting member 48 around a supporting point 56. A driven cam 58 for a cam 54 attached to the rotary shaft 53 is fixed to the lever 55. A pin 57 provided in the rear end portion of the first rod 47*a* is engaged with a concave portion of the tip of the lever 55.

Thus, when the driving motor 50 is driven, the first pulley 51*a* is rotated so that the rotation of the first pulley 51*a* is transmitted to the second pulley 51*b* by means of the driving belt 52. The rotary shaft 53 is rotated by the rotation of the second pulley 51*b* so that the cam 54 is rotated in a direction shown by an arrow R. Then, the lever 55 swings around the supporting point 56 in a direction shown by an arrow S so that the first rod 47*a* reciprocates through the pin 57 and the second rod 47*b* also reciprocates interlockingly. As a result, the movable plate 46 reciprocates in a direction shown by an arrow P (right and left with respect to the delivery direction of the paper bundle).

The lifting plate 43 is lifted in a timed manner in which the movable plate 46 moves from a position a to a position b, one of ends of the delivered paper bundle A1 directly comes in contact with the inhibiting plate 41 and the other end directly comes in contact with the movable plate 46. Next, when the movable plate 46 is reversed to move from the position b to the position a, the paper bundle A1 is dropped onto the paper bundle mounting plate 21*a*. At this time, the lifting plate 43 goes downward and directly comes in direct contact with one of the ends of the paper bundle B1 which is delivered next. The other end of the paper bundle B1 comes in direct contact with the movable plate 46.

Figure 4:
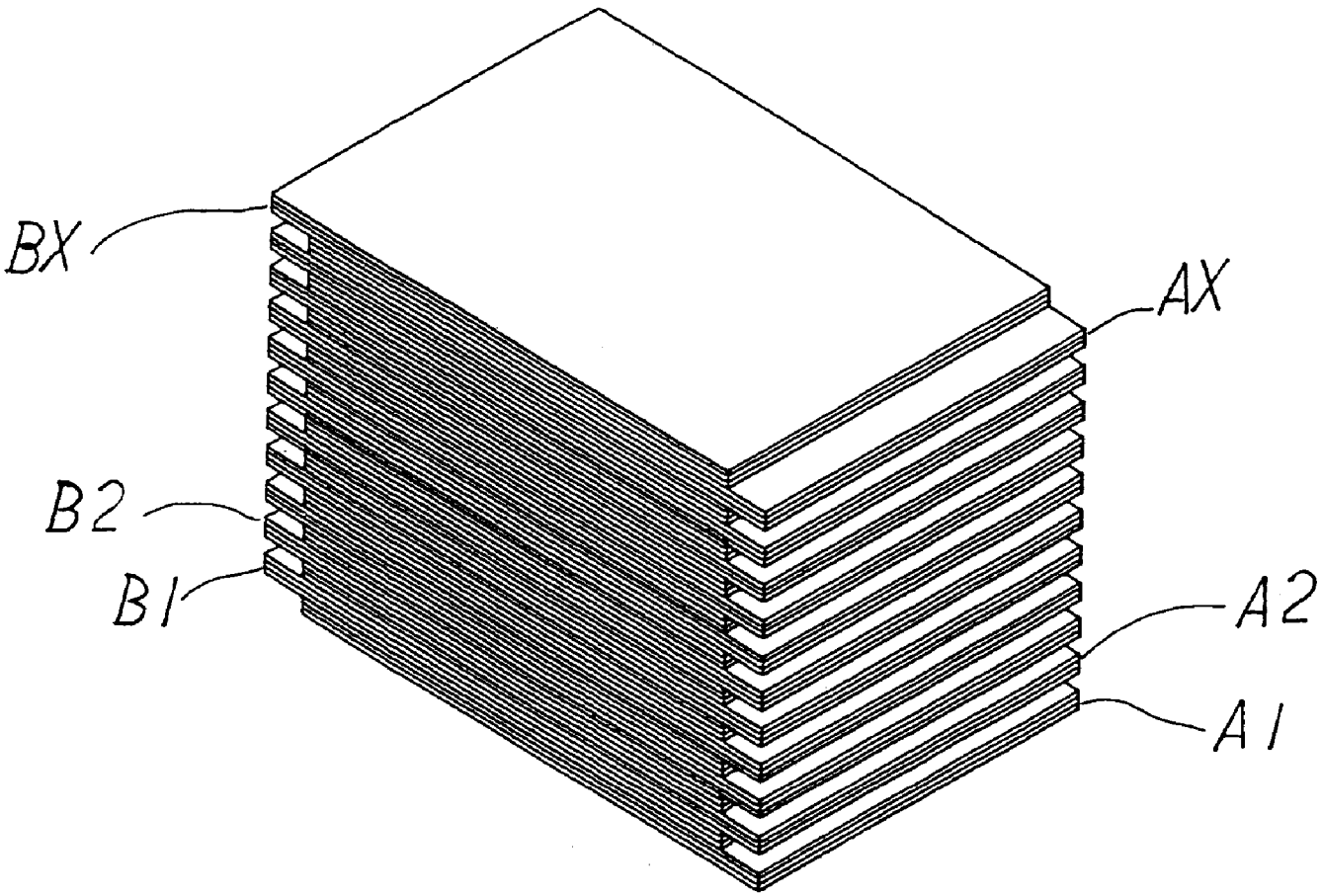
FIG. 4 is a perspective view showing an example of a state in which paper bundles are sorted and accumulated in the paper accumulating device.

When the movable plate 46 moves from the position a to a position c, the paper bundle B1 is dropped onto the paper bundle mounting plate 21*a*. Similarly in the following, the receiving operation of the movable plate 46 interlocks with the lifting operation of the lifting plate 43 so that the paper bundles sequentially delivered to the first paper bundle receiving portion 33 are alternately shifted right and left with respect to the delivery direction and are accumulated on the paper bundle mounting plate 21*a*, as shown in FIG. 4.

Furthermore, the paper accumulating device 20 according to the present invention has a control portion 70 for controlling the actuation of the switching gate plate 26 and that of the sorting mechanisms 40 and 60 of the paper bundle receiving portions 33 and 34 and for controlling the paper discharging speed of the sheet collator 1.

Next, a method for actuating the paper accumulating device 20 according to the present invention will be described. The paper bundles supplied from the paper discharging port 11 of the sheet collator 1 to the paper bundle feeding port 31 of the paper accumulating device 20 are sequentially fed. The paper bundles fed to the paper bundle feeding port 31 are introduced into the main delivery path portion 23.

The control portion 70 actuates the switching gate plate 26 in such a manner that the main delivery path portion 23 is alternately connected to the first and second branch delivery path portions 24 and 25 each time the paper bundles are delivered before the paper bundles are completely accumulated in one of the pallets forming the paper bundle receivers 21 and 22. Consequently, the paper bundles are alternately delivered to the first and second paper bundle receiving portions 33 and 34 and the paper bundles are alternately accumulated onto the first and second pallets. In the meantime, the control portion 70 controls the operation of the switching gate plate 26 and that of the sorting mechanisms 40 and 60 of the paper bundle receiving portions 33 and 34 according to the delivery speed of the paper bundles and therefore the paper discharging speed of the sheet collator 1.

Thus, the paper bundles sequentially fed from the sheet collator 1 are alternately sent to the two paper bundle receiving portions 33 and 34. In the paper bundle receiving portions 33 and 34, the paper bundles, which are sequentially delivered are alternately shifted right and left with respect to the delivery direction by means of the sorting mechanisms 40 and 60 and are then accumulated onto the pallets of the receivers 21 and 22. Accordingly, the paper bundles can be delivered to one of the paper bundle receiving portions 33 and 34 while the sorting mechanisms 40 and 60 are actuated in the other paper bundle receiving portion 33 or 34. As a result, the paper bundles can be sorted at a high speed according to the paper discharging speed of the sheet collator 1 and can be accumulated on the pallets of receivers 21 and 22. In addition, since the paper bundles are alternately shifted right and left and are accumulated, the next step of the bookbinding process can be performed rapidly.

When the sensor detects that the accumulation of the paper bundles has been completed on one of the pallets, for example, the pallet of first receiver 21, the switching gate plate 26 is actuated in such a manner that the paper bundles are delivered only to the other paper bundle receiving portion, that is, the second paper bundle receiving portion 34 until the pallet of first receiver 21 is exchanged for a new empty pallet and the paper discharging speed of the sheet collator 1 is lowered to be adapted to the operating speed of the sorting mechanism 60 of the second paper bundle receiving portion 34.

Thus, according to the present invention, non-stop operation of the sheet collator and paper accumulating device is achieved.

Figure 5:
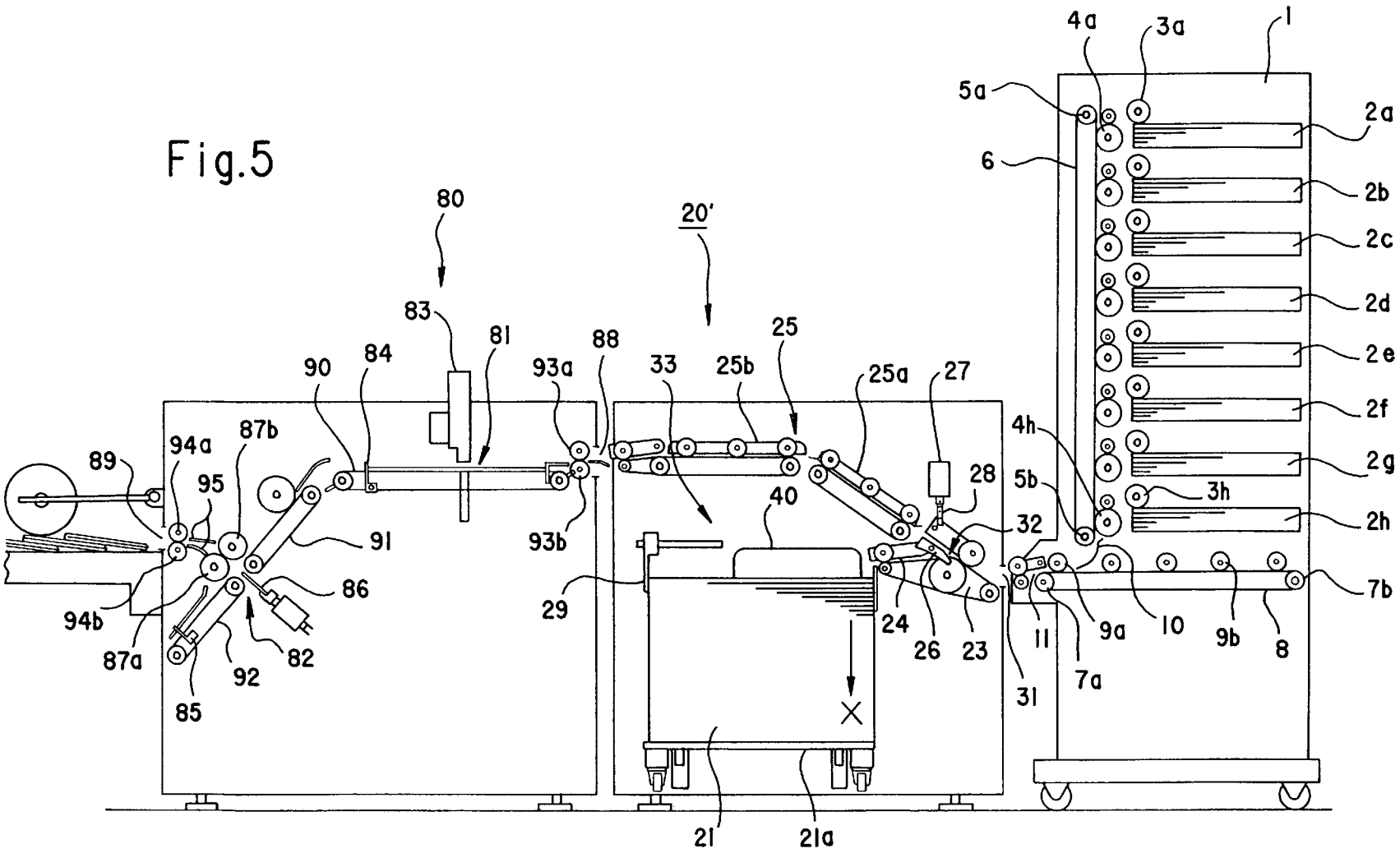
FIG. 5 is a schematic side view of a paper accumulating device according to another embodiment of the present invention.

FIG. 5 is a schematic side view showing a paper accumulating device according to another embodiment of the present invention. In the embodiment shown in FIG. 5, instead of the second paper bundle receiving portion 34 (the second paper bundle receiver 22), an apparatus 80 for stitching collated sheet bundles is connected to the second branch delivery path portions 25. The stitching apparatus 80 includes a sheet stitching station 81 and a sheet bending station 82 therein. In the sheet stitching station 81, a stitching head 83 and a first stopper 84 for a sheet bundle to be stitched along a center line thereof are installed. In the sheet bending station 82, a third stopper 85, a fold knife 86 and a pair of fold rollers 87*a*, 87*b* are arranged. The stitching apparatus 80 further includes a transport path for transporting sheet bundles from a sheet supply inlet 88 to a sheet eject outlet 89. The sheet transport path is composed of a pair of feed rollers 93*a*, 93*b*, a first conveyor belt 84, a second conveyor belt 91, a third conveyor belt 92, the fold rollers 87*a*, 87*b*, a pair of guide plates 95, 95 and a pair of delivery rollers 94*a*, 94*b*.

What is claimed is:

1. A paper accumulating device comprising a paper bundle feeding port (31), a plurality of paper bundle receiving portions (33, 34) including paper bundle receivers (21, 22) for accumulating paper bundles, and a delivery path (23, 24, 25) for delivering the paper bundles sequentially fed through the paper bundle feeding port (31) to the paper bundle receiving portions (33, 34), the paper bundle receiving portions (33, 34) being provided with sorting mechanisms (40, 60) for sorting the delivered paper bundles, the delivery path (23, 24, 25) including a main delivery path portion (23) extended from the paper bundle feeding port (31) to a branch point (32), and a plurality of mutually divergent branch delivery path portions (24, 25) extending each from the branch point (32) to one of the respective paper bundle receiving portions (33, 34), the branch point (32) being provided with a switching gate plate (26) selectively operable to connect the main delivery path portion (23) to a selected one of the branch delivery path portions (24, 25) respectively, and a control portion (70) for controlling the operation of the switching gate plate (26) and that of the sorting mechanisms (40, 60) of the paper bundle receiving portions (33, 34) according to a delivery speed of the paper bundle.

2. The paper accumulating device according to claim 1, characterized in that the paper bundle receiving portions (33, 34) are arranged in a line toward the paper bundle feeding port (31) and the branch delivery path portion (25) related to one of the paper bundle receiving portions (22) is provided across an upper portion of the paper bundle receiving portion (21) closer to the paper bundle feeding port (31) than the paper bundle receiving portion (22).

3. The paper accumulating device according to claim 2, characterized in that the sorting mechanism (40, 60) provided on the paper bundle receiving portion (33, 34) alternately shifts the sequentially delivered paper bundles right and left with respect to a delivery direction, thereby sorting the paper bundles.

4. A paper accumulating device, characterized in that a paper bundle feeding port (31), two paper bundle receiving portions (33, 34) including paper bundle receivers (21, 22) for accumulating paper bundles, and a delivery path (23, 24, 25) for delivering the paper bundles sequentially fed through the paper bundle feeding port (31) to the paper bundle receiving portions (33, 34), the paper bundle receiving portions (33, 34) being provided with sorting mechanisms (40, 60) for sorting the delivered paper bundles, the delivery path (23, 24, 25) including a main delivery path portion (23) extended from the paper bundle feeding port (31) to a branch point (32), and a plurality of mutually divergent branch delivery path portions (24, 25) extending each from the branch point (32) to one of the respective paper bundle receiving portions (33, 34), the branch point (32) being provided with a switching gate plate (26) selectively operable to connect the main delivery path portion (23) to a selected one of the branch delivery path portions (24, 25) respectively, wherein the paper bundle feeding port (31) sequentially receives the feeding of the paper bundles adjusted by the sheet collator (1), the paper bundle receiver (21, 22) provided on each of the paper bundle receiving portion (33, 34) includes a sensor for detecting that accumulation of the paper bundles is completed in the paper bundle receiver (21, 22), the paper accumulating device further comprising a control portion (70) for controlling operation of the switching gate plate (26) and a paper discharging speed of the sheet collator (1), the control portion (70) actuating the switching gate plate (26) in such a manner that the paper bundles are alternately delivered to the paper bundle receiving portions (33, 34) till the accumulation of the paper bundles is completed in one of the paper bundle receivers (21, 22), actuating the switching gate plate (26) in such a manner that the paper bundles are delivered to only one of the paper bundle receiving portions (33, 34) before the other paper bundle receiver (21, 22) is exchanged for a new empty paper bundle receiver when the sensor detects that the accumulation of the paper bundles has been completed in the paper bundle receiver (21, 22), and lowering the paper discharging speed of the sheet collator (1) to be adapted to an operating speed of the sorting mechanism (40, 60) of the other paper bundle receiving portion (33, 34).

* * * * *